US005117731A

United States Patent [19]

Mendenhall

[11] Patent Number: 5,117,731

[45] Date of Patent: Jun. 2, 1992

[54] TACTICAL ACOUSTIC DECOY

[75] Inventor: Mark A. Mendenhall, Camarillo, Calif.

[73] Assignee: The United States of America as represented by the Secretary of the Navy, Washington, D.C.

[21] Appl. No.: 787,339

[22] Filed: Nov. 4, 1991

[51] Int. Cl.[5] ..... F41F 3/04; F42B 10/16; F42B 30/00; H04K 3/00

[52] U.S. Cl. ..... 89/1.816; 102/348; 102/501; 367/1

[58] Field of Search ..... 369/1; 89/1.816, 1.3; 102/340, 348, 386, 505, 501

[56] References Cited

U.S. PATENT DOCUMENTS

| | | | |
|---|---|---|---|
| 2,901,997 | 9/1959 | Brooks | 367/1 |
| 2,998,769 | 9/1961 | Crist | 367/1 |
| 3,048,814 | 8/1962 | Francois | 367/1 |
| 3,093,107 | 6/1963 | Grand et al. | 367/1 |
| 3,702,588 | 11/1972 | Simmons | 102/340 |
| 3,841,219 | 10/1974 | Schillreff | 367/1 |
| 4,063,485 | 12/1977 | Carter et al. | 89/1.816 |
| 4,194,246 | 3/1980 | Crist | 367/1 |
| 4,286,498 | 9/1981 | Block et al. | 102/505 |
| 4,307,665 | 12/1981 | Block et al. | 367/1 |

*Primary Examiner*—David H. Brown
*Attorney, Agent, or Firm*—David S. Kalmbaugh

[57] ABSTRACT

An efficient yet relatively simple tactical acoustic decoy apparatus is disclosed for providing protective cover for a sea going vessel against homing and/or fire control devices operating on infrared, sonar or microwave reflected energy which comprises a plurality of decoy rounds constructed for launch by a decoy round launching mechanism, a load such as a transducer assembly within each decoy round which when deployed provides an effective countermeasure against homing or fire control devices and means for deploying the load.

10 Claims, 4 Drawing Sheets

TACTICAL ACOUSTIC DECOY

BACKGROUND OF THE INVENTION

1. Field of the Invention

This invention relates generally to countermeasures and, in particular, to a method and apparatus for providing protective cover against homing devices operating on sonar or microwave reflected energy or for confusing search and tracking devices.

2. Description of the Prior Art

There is a need for a countermeasures system consisting of decoy rounds for use aboard sea going military vessels which can produce targets to deceive and generate confusion in search, tracking and homing weapons systems. The countermeasures system must operate with respect to a sea going vessel, such as a ship: (1) close to the ship to confuse the ranging elements of homing weapons; (2) far enough away from the ship to minimize blast damage to the ship from weapons centered on the countermeasures system; (3) slightly below sea level to appear near sea level to long distance search weapons; and (4) sufficiently large in deceptive ability to appear to homing weapons to duplicate the target size of the smallest target sea going vessel. Generation of larger targets to simulate larger ships may require the use of several decoy rounds which are fired from the ship at close intervals.

One such device of the prior art which may be utilized to provide protective cover for ships by confusing sensing mechanisms of incoming torpedoes, missiles and the like is the decoy round countermeasure system of U.S. Pat. No. 4,307,665. U.S. Pat. No. 4,307,665 discloses a countermeasures system which includes a decoy round launching mechanism and a plurality of decoy rounds constructed for launch by the mechanism. Each decoy round, in turn, provide protective cover for the ship and includes at least one load of energy generating material, means for propelling the load, a burst charge for shattering the load and means for igniting the burst charge. Other prior art patents which disclose decoy devices to provide protective cover are U.S. Pat. Nos. 4,286,498 and 4,433,333.

While these prior art devices perform satisfactorily for their intended purpose, that is providing protective cover for sea going vessels and the like these prior art devices leave something to be desired in that these devices are not readily adaptable to movement and maneuvering of the vessel which may allow a weapon to home in on the vessel and thus damage the vessel.

Accordingly, it is an object of the present invention to provide a novel decoy apparatus.

It is another object of the present of invention to provide means for confusing energy sensor systems, particularly those operating on microwave reflected energy.

It is still another object of the invention to provide a simple and inexpensive decoy apparatus which effectively confuses the sensor systems of incoming torpedoes and the like.

It is a further object of the invention to provide a decoy system using low-cost, easily-handled rounds which provide added defense and attack support for sea based operations.

Other advantages and objects of the present invention will become apparent to those skilled in the art as a more detailed description of the invention is set forth below.

SUMMARY OF THE INVENTION

The present invention overcomes some of the disadvantages of the prior art in that it comprises an efficient yet relatively simple tactical acoustic decoy apparatus for providing protective cover for a sea going vessel against homing and/or fire control devices operating on infrared, sonar or microwave reflected energy which comprises a plurality of decoy rounds constructed for launch by a decoy round launching mechanism, a load such as a transducer assembly within each decoy round which when deployed provides an effective countermeasure against homing or fire control devices and means for deploying the load.

DETAILED DESCRIPTION OF THE PREFERRED EMBODIMENT

Figure 1:
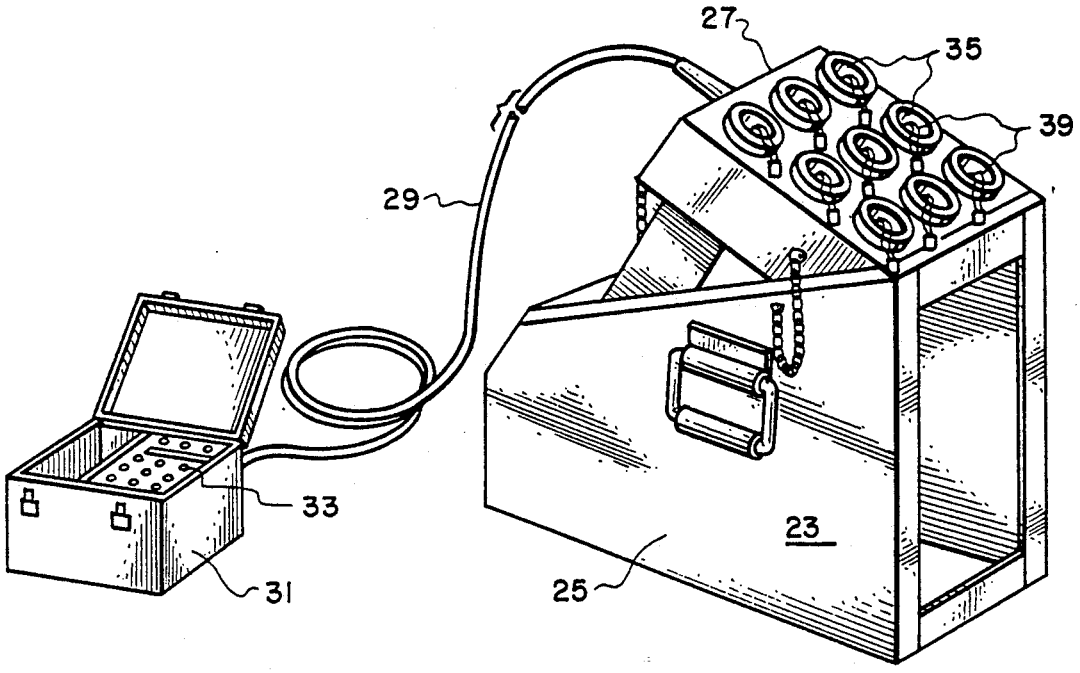
FIG. 1 is a perspective view illustrating an embodiment of a self sustained launch mechanism for launching the decoy rounds made in accordance with the present invention.
Figure 3:
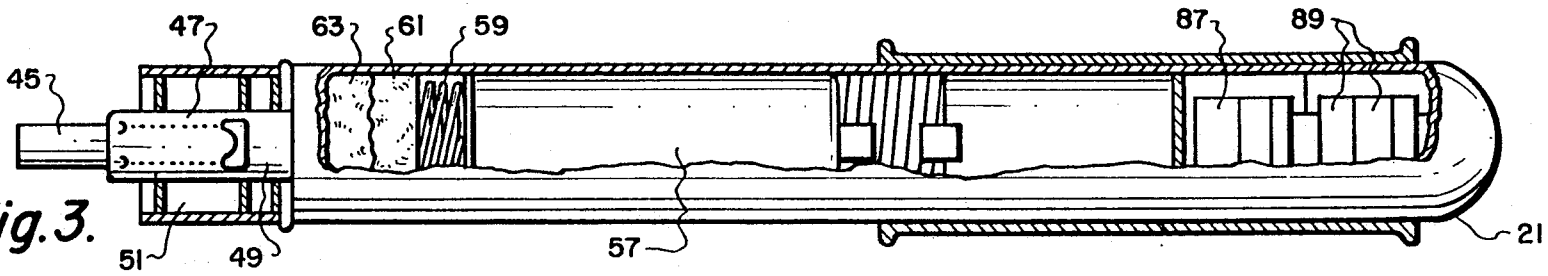
FIG. 3 is a partial sectional view illustrating the decoy round made according to the present invention.

Referring now to FIG. 1, the decoy rounds 21, FIG. 3 of the present invention produce false targets and generate confusion in search, tracking and homing weapons. The fast reloading capability of the launcher system using spare loaded containers provides protection both during attack or during retreat.

A self sustained launcher mechanism 23 which is capable of launching the FIG. 3 round 21 generally consist of a base 25, a multiple-round container unit or launcher magazine 27, a firing cable 29 and a power control unit 31. The rounds 21 are fired manually by push buttons 33 in power control unit 31. Spacing of the firing sequence of the rounds depends upon the tactical situation. The complete launcher mechanism 23 can be easily carried aboard a ship and set up in locations compatible with normal ship operations. For rough sea or land operations bolting of the base 25 of launcher mechanism 23 is normally required.

Since this invention is not directed to the specific details of the launching mechanism, only the general description and operation of the mechanism will be describe herein. It should also be understood that the launcher mechanism 23 illustrated herein is only one of several launcher apparatus which may be used to launch the decoy rounds 21, FIG. 3 of the present invention.

Figure 2:
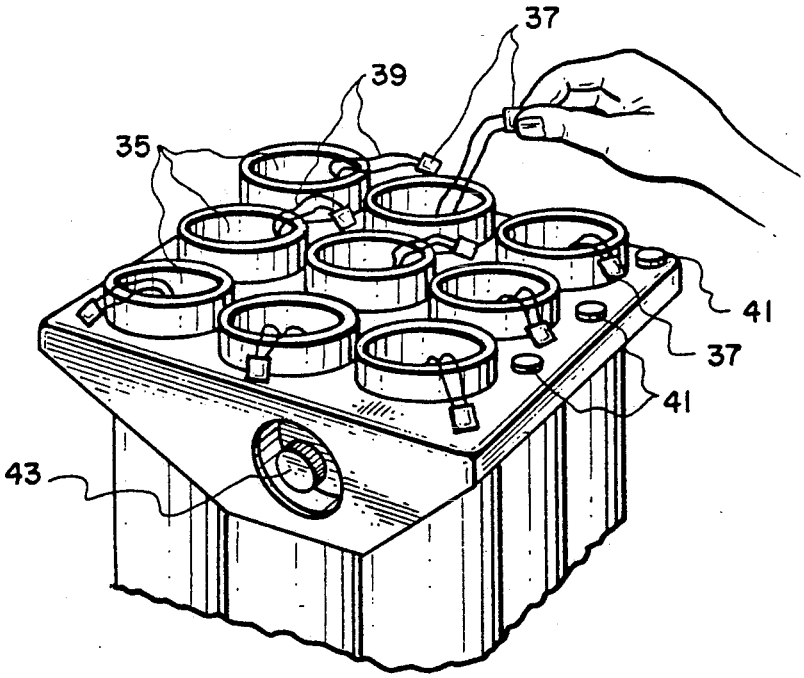
FIG. 2 is a view partially illustrating the launcher mechanism of FIG. 1.

Referring now to FIGS. 1 and 2, to load the round container unit 27, rounds such as the decoy rounds 21 of the present invention are inserted into the launch tubes 35. Spring clips 37 on squib wires 39 electrically coupled to the rounds 21 are connected to the pin sockets 41 adjacent the launch tubes 35 which, in turn, are connected via multi-terminal plug 43 to power control unit 31 thus completing the electrical circuit used to activate a firing coil 45, FIG. 3, at the base of each round 21. The entire loading of the launcher mechanism 23 can be accomplished in a very short time period normally around two minutes.

Figure 4:
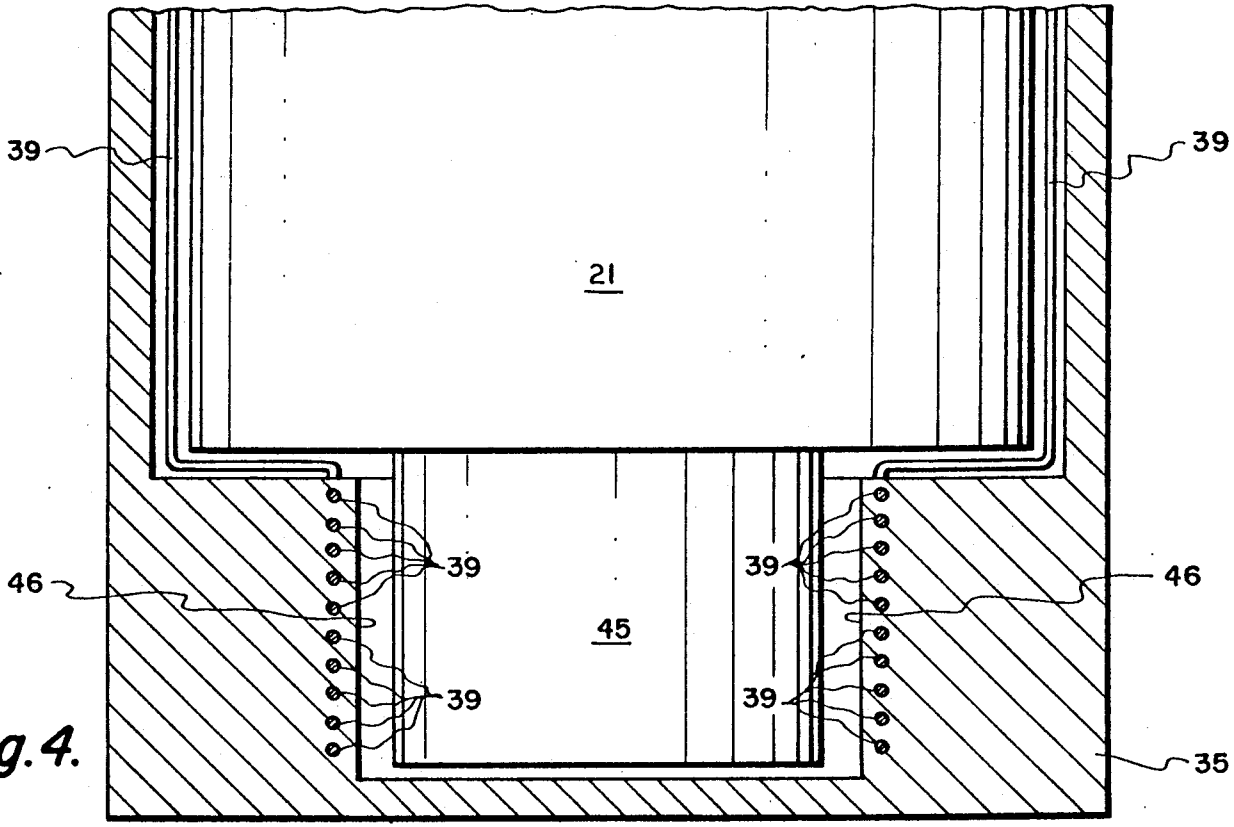
FIG. 4 is a partial sectional view of one of the launch tubes of the launch mechanism of FIG. 1 having a decoy round loaded therein.

Referring now to FIG. 4 there is a cylindrical shaped depression 46 located at the bottom end of each of the launch tubes 35 of launch mechanism 23. Depression 46, in turn, receives the firing coil 45 of round 21 when round 21 is loaded into the launch tube 35. Squib wire 39 is wound around cylindrical shaped depression 46 in the manner shown in FIG. 4 such that when an electrical current is passed through squib wire 39 an electromagnetic field is generated within depression 46 which activates the firing coil 45 of round 21.

Each round 21 is fired manually by depressing one of the push buttons 33 on the control panel of power control unit 31 which, in turn, causes power control unit 31 to generate an electrical current causing an electromagnetic field within in depression 46 which activates firing coil 45. The corresponding of push buttons 33 to the launch tubes 35 may be such that when both are viewed from the top, the round container plug 43 and the top of the push buttons 33 are in the same relative position.

It should be understood that the power control unit 31 may, for example, include a switch and switch guard so arranged such that when the guard is lifted the switch can be thrown from a safe to an armed position. In the armed position, a red light, for example may be illuminated and the launcher system is ready for firing.

Referring now to FIGS. 1, 2 and 3, the round 21 is stored in ready service lockers, not shown, which are in close proximity to the launcher mechanism 23 prior to loading. The rounds 21 are next loaded into the launch tubes 35 of launch mechanism 23 in preparation for launch. Manually depressing one of the push buttons 33 will cause power control unit 31 to generate an electromagnetic field within depression 46 of the corresponding launch tube 35 which activates firing coil 45 exciting simultaneously both a lift/propelling charge 47 and a time delay detonator 49 located within the booster assembly 51 at the rear of round 21. The lift charge 47, in turn, propels the round 21 from the launcher mechanism 23 in a ballistic trajectory.

Figure 5:
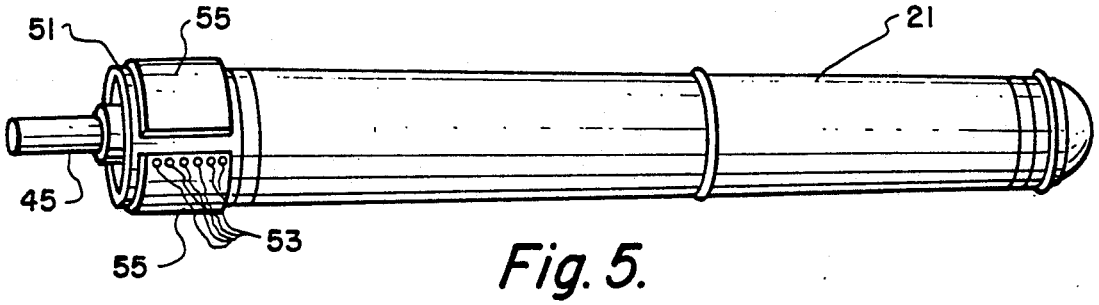
FIG. 5 is a side view of the decoy round of the present invention.
Figure 6:
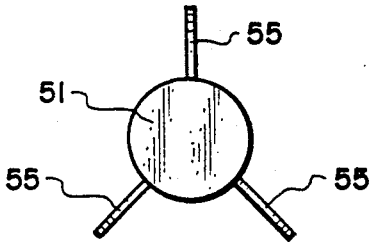
FIG. 6 is a rear view of the decoy round illustrating the stabilization fins of the decoy round in their in-flight position.

Referring to FIG. 5 the booster assembly 51 of each decoy round 21 has affixed to its outer surface by rivets 53 or the like and wrapped around its outer surface three expanding stabilization fins 55. When the decoy round 21 exits the launch tube 35 of launch mechanism 23 the gases and residual pressure generated by propelling charge 47 will cause the stabilization fins to expand outward from booster assembly 51 as is best illustrated in FIG. 6 and thereby provide in-flight stability for decoy round 21 during flight. Approximately five to eight seconds after the decoy round 21 exits the launch tube 35 the time delay detonator 49 ignites jettisoning booster assembly 51 from round 21.

Figure 7:
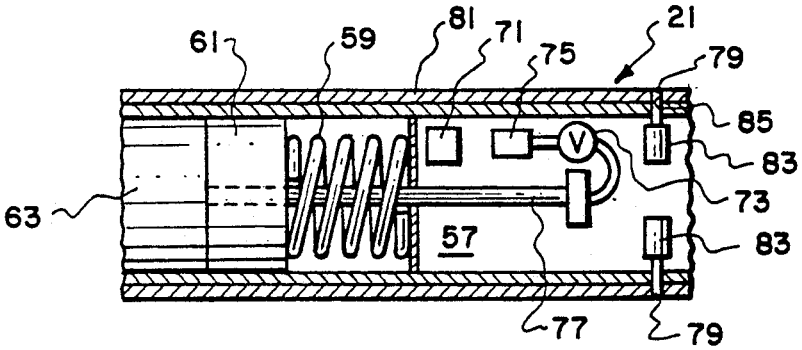
FIG. 7 is a partial sectional view illustrating the surface assembly of the decoy round of the present invention.

Referring to FIGS. 3, 7 and 8 decoy round 21 includes at the rear portion thereof a surface assembly 57. When booster assembly 51 is jettisoned/separated from decoy round 21, a spring 59, which is positioned within surface assembly 57 exerts a force upon a spiral air brake 61 and a float 63 attached to air brake 61 forcing the air brake 61 and float 63 from the surface assembly 57 of decoy round 21.

As is best illustrated in FIG. 8(*a*), the spiral air brake 61 when expelled from surface assembly 57 unfolds and then functions as a brake slowing decoy round 21 to an air speed acceptable for entry into water. Spiral air brake 61 which is umbrella like in structure may be fabricated from a cloth material or fabric 65 supported by a collapsible frame of thin ribs 67. Ribs 67, in turn, may be fabricated from a flexible corrosion resistant steel alloy.

As is best illustrated in FIG. 8(*b*), when decoy round 21 enters seawater, a float cover 69 is expelled from the float 63. At the same time seawater enters the interior of surface assembly 57 energizing a lithium battery pack 71 contained within surface assembly 57. Lithium battery pack 71 is electrically coupled to a normally closed valve 73 which is opened when battery pack 71 is energized. When valve 73 is opened carbon dioxide stored in a gas cylinder 75 within surface assembly 57 is released from cylinder 75 passing through valve 73 and a supply line 77 to float 63 thereby inflating float 63 as is best illustrated in FIGS. 8(*b*)–8(*d*). It should be noted that supply line 77 also secures spiral air brake 61 and float 63 to surface assembly 57 and that the ribs 67 of brake 61 are attached to supply line 77.

Figure 9:
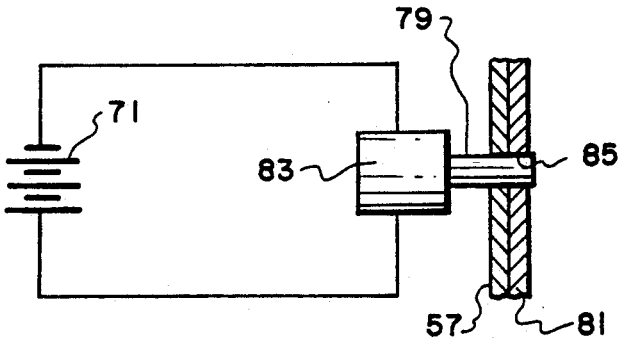
FIG. 9 is an enlarged view illustrating one of the release pins used to secure the surface assembly to the decoy housing of the present invention.
Figure 8A:
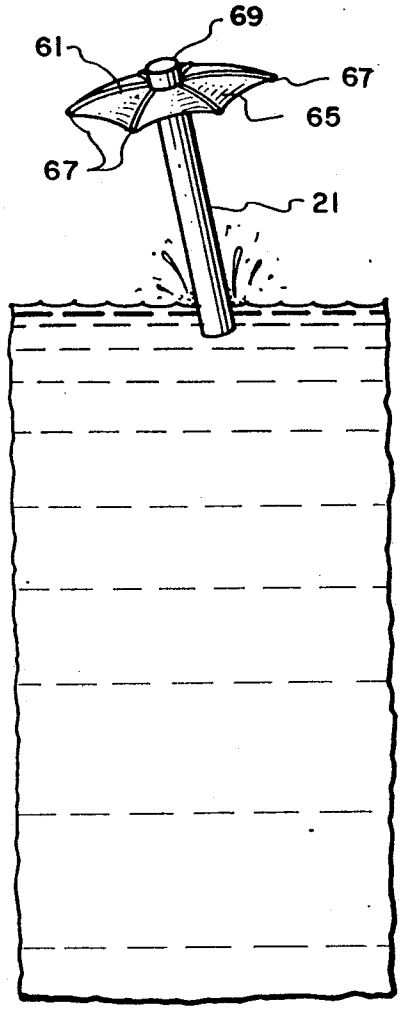
FIGS. 8(*a*)–8(*d*) illustrate the decoy round of the present invention entering seawater.
Figure 8B:
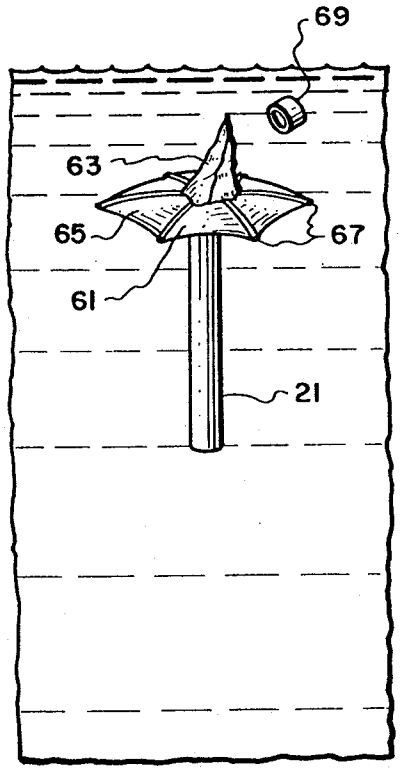
Figure 8C:
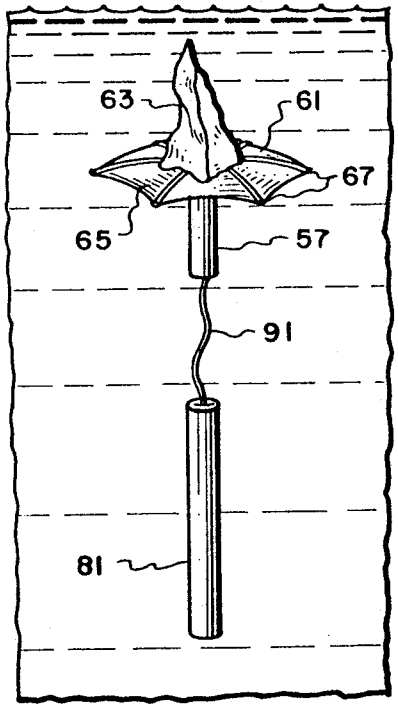
Figure 8D:
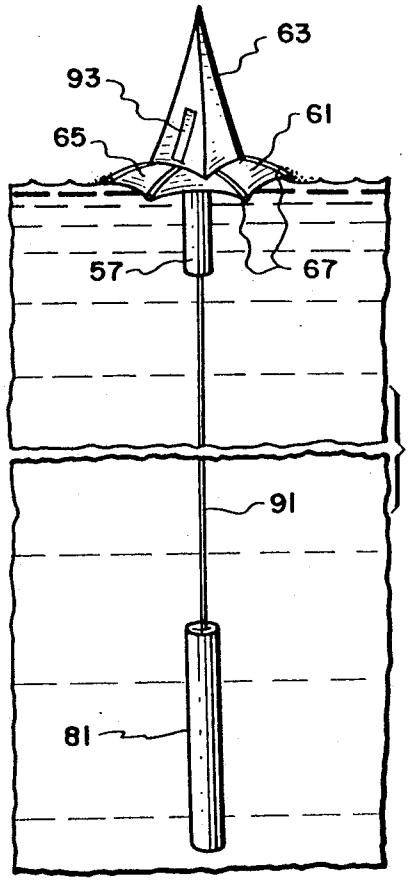

Referring to FIGS. 7–9, surface assembly has therein at least a pair of release pins 79 which function to secure the surface assembly 57 to the decoy housing 81 of decoy round 21. Activation of battery pack 71 by seawater energizes a solenoid 83 coupled to each release pin 79 thereby causing the release pin 79 to withdraw from an aperture 85 within housing 81 which allows surface assembly 57 to separate from decoy housing 81 as is best illustrated by FIGS. 8(*c*) and 8(*d*).

Referring to FIGS. 3 and 8, the forward portion of decoy housing 81 contains a transducer assembly 87 comprising a plurality of transducer elements 89 which emit acoustic signals to simulate the signature of a ship and thereby confuse the sensing mechanism of a weapon such as a torpedo so as to divert the weapon from the ship to decoy round 21. When fully deployed, the decoy housing 81 of decoy round 21 is electrically and mechanically coupled to surface assembly 57 by a cable 91. Power for the transducer elements 89 of transducer assembly 87 is provided by battery pack 71 via cable 91. In the decoy round of the present invention, decoy housing 81 was fabricated from aluminum so as to function as an acoustic window to transducer assembly 87.

It should be understood that decoy housing 81 may include other electronic countermeasure devices to generate false target for the homing mechanism of an incoming weapon. Further, float 63 may include a one quarter wavelength microstrip antenna 93, FIG. 8(*d*), so as to allow for communication between a ship and the electronic countermeasures housed aboard decoy round 21.

From the foregoing it may be seen that the present invention comprises a new, unique and exceedingly useful decoy round which constitutes a considerable improvement over the known prior art. Obviously many modifications and variations of the present invention are possible in light of the above teachings. It is therefore to be understood that within the scope of the appended claims that the invention may be practiced otherwise than as specifically described.

What is claimed is:

1. In combination, a decoy round launch mechanism and at least one decoy round adapted for launch by said mechanism; said decoy round including a transducer assembly having a plurality of transducer elements for emitting acoustic signals to confuse an energy sensing apparatus, thrusting means positioned at the rear of said decoy round for propelling said decoy round in a ballistic trajectory, said decoy round having braking means positioned within the rear part of said decoy round, said braking means being jettisoned from said decoy round during flight for slowing said decoy round to an air speed which will allow said decoy round to enter seawater.

2. The combination of claim 1 wherein said launching mechanism includes a plurality of cylindrical shaped launch tubes each of said launch tubes having a cylindrical shaped depression at the bottom of said tube, said cylindrical shaped depression having a wire wound around the periphery thereof such that when an electrical current passes through said wire an electro-magnetic field is generated within said depression.

3. The combination of claim 1 wherein said thrusting means comprises a booster assembly positioned at the rear of said decoy round, said booster assembly having a firing coil, a lift propelling charge and a time delay detonator, said lift propelling charge and said time delay detonator being connected to said firing coil such that when said firing coil is activated said lift propelling charge and said time delay detonator are simultaneously exited.

4. The combination of claim 1 wherein said launching mechanism comprises a portable type launch mechanism having a base, a multiple-round container unit mounted upon said base, said multiple round container unit having a plurality of launch tubes, each of said launch tubes being adapted to receive one of said decoy rounds for firing therefrom, a firing cable and a power control unit operatively connected to said multiple round container unit by said firing cable.

5. The combination of claim 4 wherein said power control unit has a plurality of push buttons, each of said push buttons being electrically connected to one of said plurality of launch tubes such that when one of said push buttons is activated the launch tube electrically connected to said push button fires the decoy round within said tube from said tube.

6. The combination of claim 1 wherein said decoy round includes a surface assembly and a decoy housing, said surface assembly being secured to said decoy housing by at least a pair of release pins, each of said release pins having a solenoid coupled thereto, each of said release pins passing through an aperture within said decoy housing such that upon energization of said solenoid said release pin is withdrawn from the aperture within said decoy housing thereby allowing said decoy housing to separate from said surface assembly.

7. The combination of claim 6 further characterized by a cable connected between said decoy housing and said surface assembly.

8. The combination of claim 1 wherein said decoy round includes a float attached to said braking means, said float and said braking means being deployed from said decoy round during flight for slowing said decoy round to an air speed which will allow said decoy round to enter water.

9. The combination of claim 8 further characterized by a gas cylinder positioned within the rear portion of said decoy round, a supply line connecting said float to said gas cylinder and a normally closed valve located within said supply line, said normally closed valve being electrically coupled to a lithium battery pack such that when said lithium battery pack is energized upon entry into seawater said valve is opened allowing carbon dioxide stored in said gas cylinder to inflate said float.

10. The combination of claim 8 wherein said float includes a quarter wavelength microstrip antenna positioned on the outer surface thereof.

* * * * *